US007195572B1

(12) United States Patent
Swain

(10) Patent No.: US 7,195,572 B1
(45) Date of Patent: Mar. 27, 2007

(54) TENNIS COURT PROTECTION SYSTEM

(76) Inventor: Traci Swain, 3945 Cortez Way South, St. Petersburg, FL (US) 33712

( * ) Notice: Subject to any disclaimer, the term of this patent is extended or adjusted under 35 U.S.C. 154(b) by 0 days.

(21) Appl. No.: 11/131,856

(22) Filed: May 18, 2005

(51) Int. Cl.
*A63C 19/12* (2006.01)

(52) U.S. Cl. ..... 473/504

(58) Field of Classification Search ..... 473/504, 473/415, 459, 474; 24/389; 135/115, 119
See application file for complete search history.

(56) References Cited

U.S. PATENT DOCUMENTS

| | | | | | |
|---|---|---|---|---|---|
| 974,091 | A | * | 10/1910 | O'Donnell | 473/504 |
| 1,088,407 | A | * | 2/1914 | Derr | 473/504 |
| 1,580,396 | A | * | 4/1926 | Woodward | 473/504 |
| 1,966,687 | A | * | 7/1934 | Scott et al. | 473/504 |
| 2,540,380 | A | * | 2/1951 | Schultheis | 473/504 |
| 2,578,135 | A | * | 12/1951 | Hoigaard et al. | 473/504 |
| 2,848,233 | A | * | 8/1958 | Wynn | 473/504 |
| 3,108,804 | A | * | 10/1963 | Wagner | 473/504 |
| 3,975,869 | A | | 8/1976 | Bouton | |
| 4,088,317 | A | * | 5/1978 | Gierla | 473/474 |
| 4,641,600 | A | | 2/1987 | Halvorsen | |
| 5,150,510 | A | * | 9/1992 | Moreland | 52/741.4 |
| 5,365,704 | A | | 11/1994 | Ray | |

FOREIGN PATENT DOCUMENTS

| | | | |
|---|---|---|---|
| EP | 56539 | A1 * | 7/1982 |
| FR | 2580707 | A1 * | 10/1986 |

* cited by examiner

*Primary Examiner*—Mitra Aryanpour
(74) *Attorney, Agent, or Firm*—Edward P. Dutkiewicz

(57) ABSTRACT

A first surface is susceptible to inclement weather. The first surface has a pair of poles. A net is coupled between the poles. A cover has a lower face and a pair of sides. The cover has a plurality of wheels rotatably coupled to the cover. A drive assembly has a motor. The motor is adjacent to one of the long sides of the first surface. The motor is mechanically coupled to the cover.

1 Claim, 3 Drawing Sheets

FIG 1
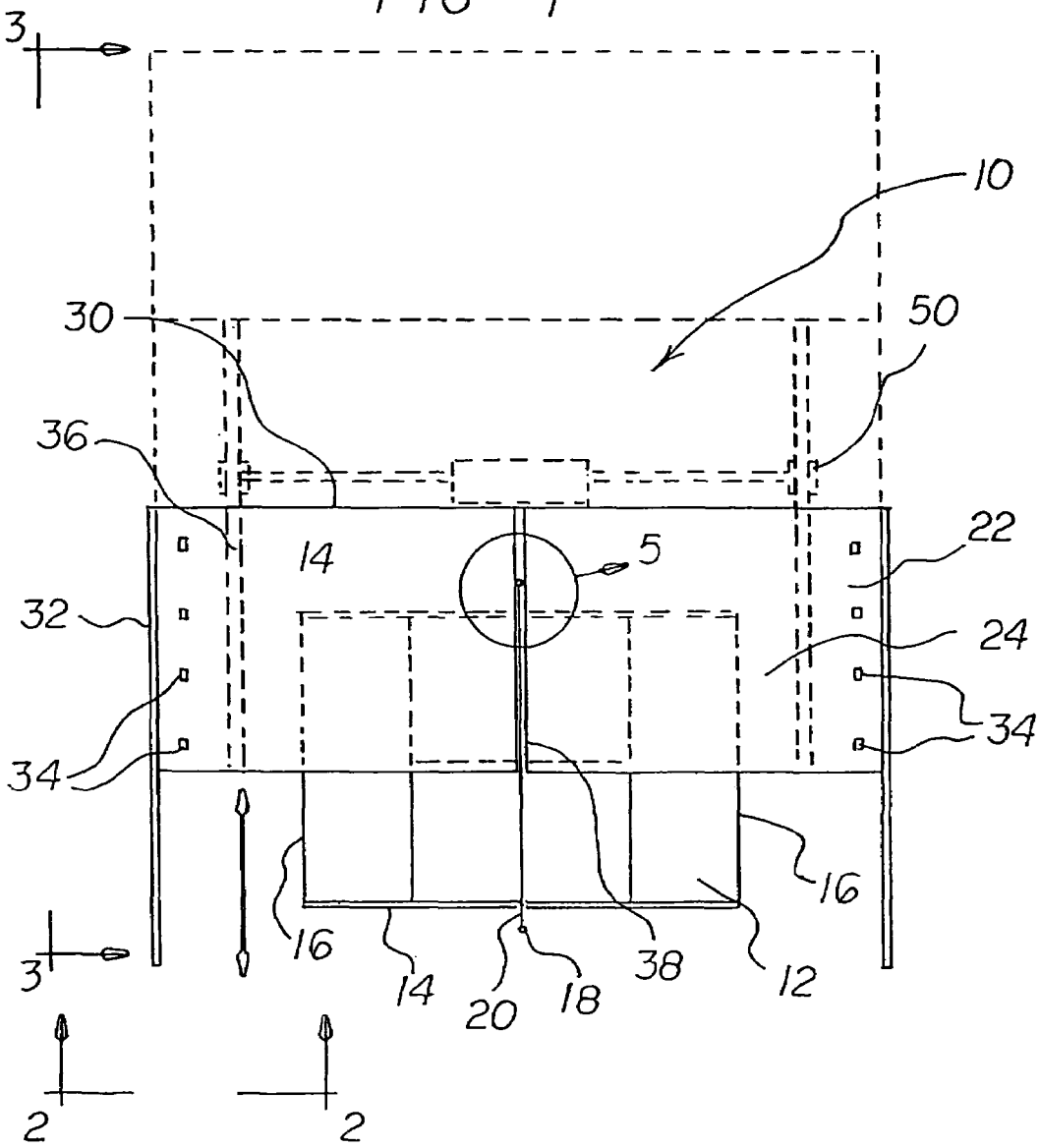
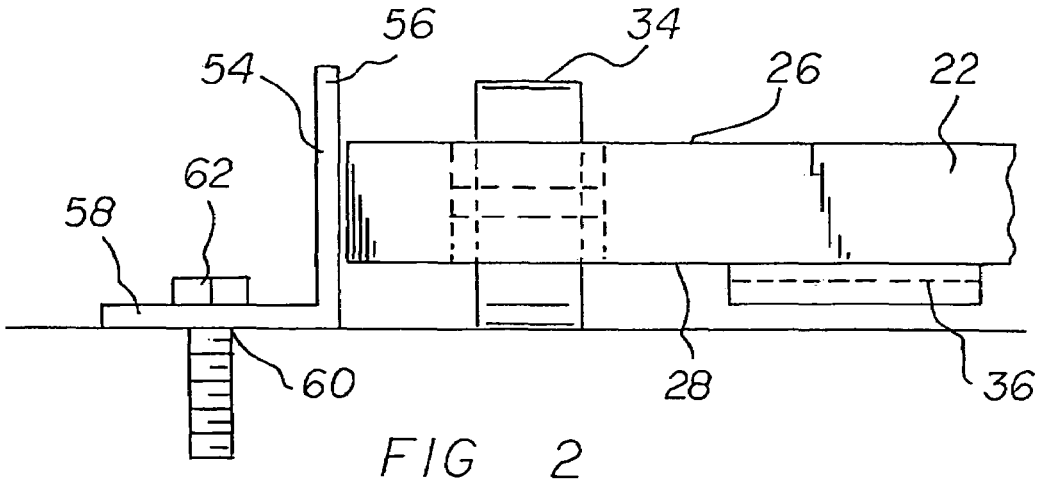
FIG 2

FIG 3
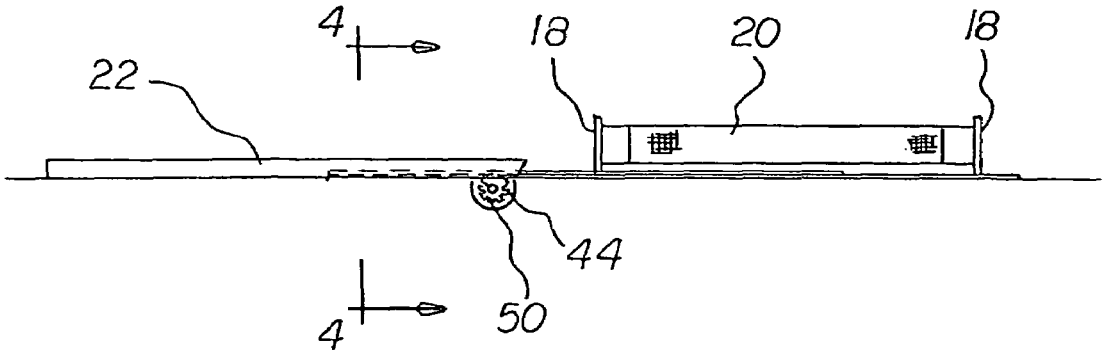
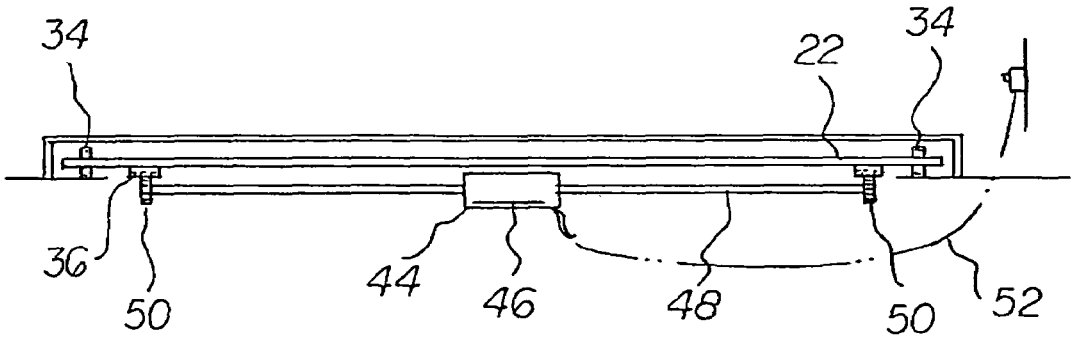
FIG 4

TENNIS COURT PROTECTION SYSTEM

BACKGROUND OF THE INVENTION

1. Field of the Invention

The present invention relates to a tennis court protection system and more particularly pertains to securely covering a tennis court in a secure and reliable manner.

2. Description of the Prior Art

The use of recreation systems of known designs and configurations is known in the prior art. More specifically, recreation systems of known designs and configurations previously devised and utilized for the purpose of covering recreation apparatuses through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,975,869 to Bouton issued Aug. 24, 1976 discloses a Sports Complex. U.S. Pat. No. 4,641,600 to Halvorsen issued Feb. 10, 1987 discloses a Rolling Boat Cover. U.S. Pat. No. 4,650,180 to Blondel issued Mar. 17, 1987 discloses a Sports Ground, In Particular Tennis Court Or Mini Court Formed By Using Removable Panels. Lastly, U.S. Pat. No. 5,365,704 to Ray issued Nov. 22, 1944 discloses an Activity Floor Changing System For Multi-Activity Complex.

While these devices fulfill their respective, particular objectives and requirements, the aforementioned patents do not describe tennis court protection system that allows securely covering a tennis court in a secure and reliable manner.

In this respect, the tennis court protection system according to the present invention substantially departs from the conventional concepts and designs of the prior art, and in doing so provides an apparatus primarily developed for the purpose of securely covering a tennis court in a secure and reliable manner.

Therefore, it can be appreciated that there exists a continuing need for a new and improved tennis court protection system which can be used for securely covering a tennis court in a se-cure and reliable manner. In this regard, the present invention substantially fulfills this need.

SUMMARY OF THE INVENTION

In view of the foregoing disadvantages inherent in recreation systems of known designs and configurations now present in the prior art, the present invention provides an improved tennis court protection system. As such, the general purpose of the present invention, which will be described subsequently in greater detail, is to provide a new and improved tennis court protection system and method which has all the advantages of the prior art and none of the disadvantages.

To attain this, the present invention essentially comprises a tennis court protection system. First provided is a first surface. The first surface is susceptible to inclement weather. Inclement weather includes, but is not limited to rain, snow, sleet, hail and the like. The first surface has a first pair of parallel long sides. The first surface has a first pair of parallel short sides. The short sides are between the long sides. A first width is provided. The first width is measured between the first long sides. The surface has a pair of upstanding poles. The poles are positioned at midpoints of the long sides. The poles are coupled to the first surface. A net is provided. The net is coupled between the poles.

A cover is provided. The cover is in a generally rectangular configuration. The cover is fabricated of a rigid material. The rigid material is preferably metal. The cover is adapted to receive colors, designs and indicia. The cover has an upper face. The cover has a lower face. The cover has a pair of second parallel long sides. The cover also has a pair of second parallel short sides. The short sides are provided between the long sides. A second width is provided. The second width is measured between the second long sides. The second width is greater than the first width. The cover also has a plurality of wheels. The wheels are rotatably coupled to the cover adjacent to the short sides. The cover further has a pair of corrugated racks. The racks run parallel with the short sides. The racks are coupled to the lower face of the cover. The cover additionally has a linear slot. The slot runs through a midline equidistant between the short sides. The slot has a pair of edges. Each edge is formed with a flexible elastomeric lip. The lips are adapted to allow the poles to pass through the cover and still protect the first surface.

Further provided is a drive assembly. The drive assembly has a motor. The motor is adjacent to one of the long sides of the first surface. The drive assembly has a drive shaft. The drive shaft is mechanically coupled to the motor. The drive assembly has a pair of gears. The gears are provided at the ends of the drive shaft. The gears are operatively coupled to the racks of the cover. In this manner a rack and pinion configuration is formed. The gears are adapted to move the cover on and off of the first surface. The motor has a power source and a control panel. The control panel is position adjacent to the first surface. A wire is provided. The control panel is coupled to the motor with the wire.

Provided last is a pair of retainer walls. The retainer walls have a long configuration. The retainer walls are fabricated of a rigid material. The retainer walls each have an L-shaped cross sectional configuration. The retainer walls each have a vertical portion. The vertical portions are adapted to keep the rack on the cover in contact with the gears on the drive shaft. The retainer walls each have a horizontal portion. The horizontal portion has a plurality of apertures. Bolts are provided. The bolts couple the retainer wall to the ground adjacent to the long sides of the first surface.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tennis court protection system which has all of the advantages of the prior art recreation systems of known designs and configurations and none of the disadvantages.

It is another object of the present invention to provide a new and improved tennis court protection system which may be easily and efficiently manufactured and marketed.

It is further object of the present invention to provide a new and improved tennis court protection system which is of durable and reliable constructions.

An even further object of the present invention is to provide a new and improved tennis court protection system which is susceptible of a low cost of manufacture with regard to both materials and labor, and which accordingly is then susceptible of low prices of sale, thereby making such tennis court protection system economically available.

Even still another object of the present invention is to provide a tennis court protection system for securely covering a tennis court in a secure and reliable manner.

Lastly, it is an object of the present invention to provide a new and improved tennis court protection system. A first surface is susceptible to inclement weather. The first surface has a pair of poles. A net is coupled between the poles. At least one cover has a lower face and a pair of sides. The cover has a plurality of wheels rotatably coupled to the cover. A drive assembly has at least one motor. The motor is adjacent to one of the long sides of the first surface. The motor is mechanically coupled to the cover.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view illustrating the preferred embodiment of the present invention.

FIG. 2 is a front elevational view of the present invention taken along line 2—2 of FIG. 1.

FIG. 3 is side elevational view of the present invention taken along line 3—3 of FIG. 1.

FIG. 4 is cross sectional view of the present invention taken along line 4—4 of FIG. 3.

The same reference numerals refer to the same parts throughout the various Figures.

DESCRIPTION OF THE PREFERRED EMBODIMENT

Figure 5:
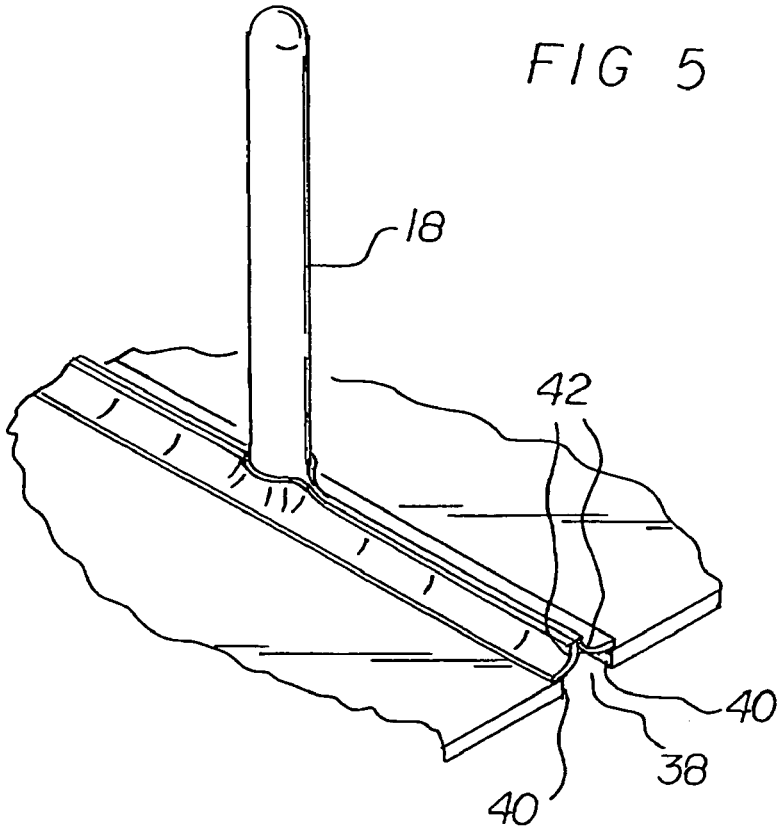
FIG. 5 is an enlarged plan view of the pole of the present invention taken from circle 5 of FIG. 1.

With reference now to the drawings, and in particular to FIG. 1 thereof, the preferred embodiment of the new and improved tennis court protection system embodying the principles and concepts of the present invention and generally designated by the reference numeral 10 will be described.

The present invention, the tennis court protection system 10 is comprised of a plurality of components. Such components in their broadest context include a first surface, at least one cover, a drive assembly, and rectilinear walls. Such components are individually configured and correlated with respect to each other so as to attain the desired objective.

First provided is a first surface 12. The first surface is susceptible to inclement weather. Inclement weather includes, but is not limited to rain, snow, sleet, hail and the like. The first surface has a first pair of parallel long sides 14. The first surface has a first pair of parallel short sides 16. The short sides are between the long sides. A first width is provided. The first width is measured between the first long sides. The surface has a pair of upstanding poles 18. The poles are positioned at midpoints of the long sides. The poles are coupled to the first surface. A net 20 is provided. The net is coupled between the poles.

A cover 22 is provided. The cover is in a generally rectangular configuration. The cover is fabricated of a rigid material. The rigid material, preferably metal, is selected from the class of rigid materials including steel, an aluminum alloy, plastic and glass with a hard plastic coating. The cover is adapted to receive colors, designs and indicia 24.

The cover has an upper face 26. The cover has a lower face 28. The cover has a pair of second parallel long sides 30. The cover also has a pair of second parallel short sides 32. The short sides are provided between the long sides. A second width is provided. The second width is measured between the second long sides. The second width is greater than the first width. The cover also has a plurality of wheels 34. The wheels are rotatably coupled to the cover adjacent to the short sides. The cover further has a pair of corrugated racks 36. The racks run parallel with the short sides. The racks are coupled to the lower face of the cover. The cover additionally has a linear slot 38. The slot runs through a midline equidistant between the short sides. The slot has a pair of edges 40. Each edge is formed with a flexible elastomeric lip 42. The lips are adapted to allow the poles to pass through the cover and still protect the first surface.

Further provided is a drive assembly 44. The drive assembly has a motor 46. The motor is adjacent to one of the long sides of the first surface. The drive assembly has a drive shaft 48. The drive shaft is mechanically coupled to the motor. The drive assembly has a pair of gears 50. The gears are provided at the ends of the drive shaft. The gears are operatively coupled to the racks of the cover. In this manner a rack and pinion configuration is formed. The gears are adapted to move the cover on and off of the first surface. The motor has a power source and a control panel. The control panel is position adjacent to the first surface. A wire 52 is provided. The control panel is coupled to the motor with the wire.

Provided last is a pair of retainer walls 54. The retainer walls have a long configuration. The retainer walls are fabricated of a rigid material. The retainer walls each have an L-shaped cross sectional configuration. The retainer walls each have a vertical portion 56. The vertical portions are adapted to keep the rack on the cover in contact with the gears on the drive shaft. The retainer walls each have a horizontal portion 58. The horizontal portion has a plurality of apertures 60. Bolts 62 are provided. The bolts couple the retainer wall to the ground adjacent to the long sides of the first surface.

Figure 6:
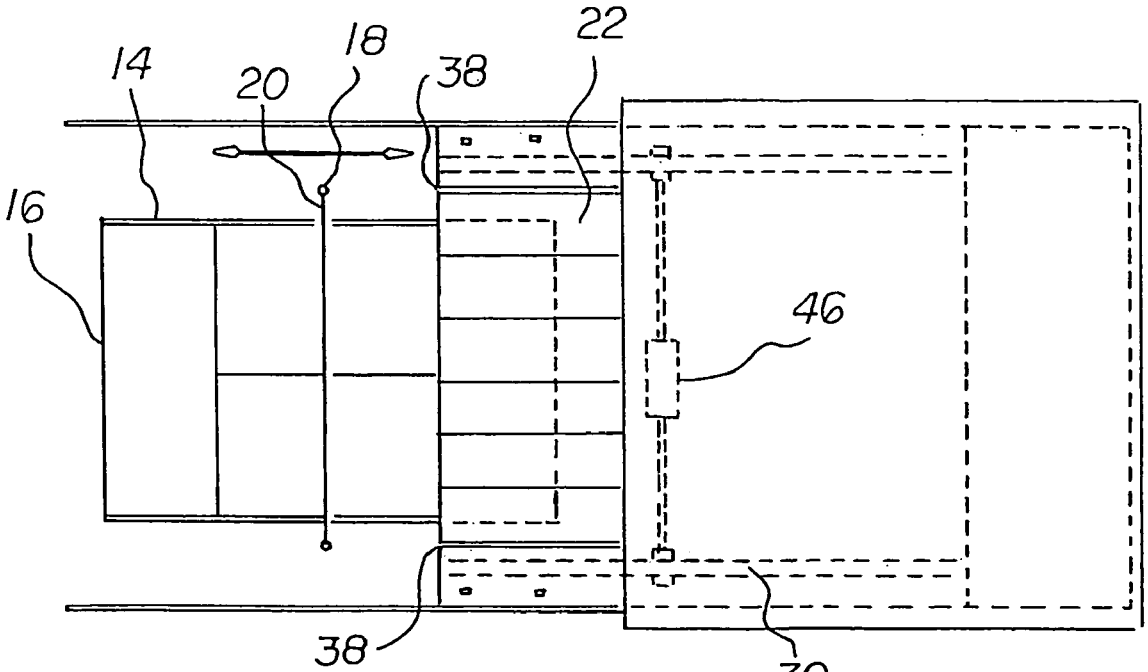
FIG. 6 is a plan view of an alternate embodiment of the present invention where the cover is slide to and from the covering position from the end.

An alternate embodiment of the invention is illustrated in FIG. 6. In the primary embodiment, the system includes two cover sections with one slot, the cover sections being adapted to come from a side. In the alternate embodiment, the system includes three cover sections with two slots, the cover sections being adapted to come from an end. The covers are formed of panels, preferably foldable panels, to facilitate transportation and storage of the system. In a further alternate embodiment, the system includes two covers with independent driving motors, the covers being adapted to come from each end and meet adjacent to the opposite sides of the net. In a further embodiment of the invention, the poles are coupled to the first surface with a flexible material whereby when the cover comes in contact with the pole, the poles fold downward during storage.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A tennis court protection system for securely covering a tennis court in a secure and reliable manner comprising, in combination:

a first surface susceptible to inclement weather, the first surface having a first pair of parallel long sides and a first pair of parallel short sides there between, with a first width being measured between the first long sides, the surface having a pair of upstanding poles positioned at midpoints of the long sides, the poles being coupled to the first surface with a net coupled between the poles;

a cover in a generally rectangular configuration and fabricated of a rigid material preferably metal, the cover being adapted to receive colors, designs and indicia, the cover having an upper face, a lower face, a pair of second parallel long sides and a pair of second parallel short sides there between with a second width being measured between the second long sides, the second width being greater than the first width, the cover also having a plurality of wheels rotatably coupled to the cover adjacent to the short sides, the cover further having a pair of corrugated racks running parallel with the short sides and being coupled to the lower face of the cover, the cover additionally having a linear slot running through a midline equidistant between the short sides, the slot having a pair of edges with each edge formed with a flexible elastomeric lip adapted to allow the poles to pass through the cover and still protect the first surface;

a drive assembly with a motor adjacent to one of the long sides of the first surface with a drive shaft mechanically coupled to the motor and with a pair of gears at the ends of the drive shaft, the gears being operatively coupled to the racks of the cover forming a rack and pinion configuration and being adapted to move the cover on and off of the first surface, the motor having a power source and a control panel, the control panel being position adjacent to the first surface and coupled to the motor with a wire; and a pair of retainer walls having a long configuration and fabricated of a rigid material, the retainer walls each having an L-shaped cross sectional configuration with a vertical portion adapted to keep the rack on the cover in contact with the gears on the drive shaft and with a horizontal portion having a plurality of apertures with bolts coupling the retainer wall to the ground adjacent to the long sides of the first surface.

* * * * *